US007681905B2

(12) United States Patent
Hauglin

(10) Patent No.: US 7,681,905 B2
(45) Date of Patent: Mar. 23, 2010

(54) SKI BINDING, ESPECIALLY TELEMARK BINDING

(75) Inventor: Bernt-Otto Hauglin, Røyken (NO)

(73) Assignee: Rottefella AS, Klokkarstua (NO)

( * ) Notice: Subject to any disclaimer, the term of this patent is extended or adjusted under 35 U.S.C. 154(b) by 288 days.

(21) Appl. No.: 11/701,642

(22) Filed: Feb. 1, 2007

(65) Prior Publication Data

US 2008/0185820 A1 Aug. 7, 2008

(51) Int. Cl.
*A63C 9/00* (2006.01)

(52) U.S. Cl. ..... 280/615; 280/611; 280/614; 280/616; 280/617; 280/623; 280/626; 280/634; 280/635

(58) Field of Classification Search ..... 280/611, 280/614, 616, 617, 618, 623, 626, 634, 635, 280/615, 624, 629, 633
See application file for complete search history.

(56) References Cited

U.S. PATENT DOCUMENTS

| | | | | |
|---|---|---|---|---|
| 1,964,103 | A * | 6/1934 | Attenhofer | 280/614 |
| 5,344,178 | A * | 9/1994 | Rohrmoser | 280/617 |
| 6,588,791 | B1 * | 7/2003 | Horn | 280/613 |
| 7,216,888 | B1 * | 5/2007 | Walker et al. | 280/614 |
| 2003/0155742 | A1 * | 8/2003 | Riedel et al. | 280/615 |
| 2004/0207177 | A1 | 10/2004 | Riedel et al. | |
| 2007/0126204 | A1 | 6/2007 | Riedel et al. | |

FOREIGN PATENT DOCUMENTS

| | | |
|---|---|---|
| DE | 10 2004 023 832 | 11/2002 |
| DE | 101 24 893 | 11/2003 |
| DE | 103 19 675 | 6/2005 |
| WO | WO 03/101555 | 12/2003 |

* cited by examiner

*Primary Examiner*—Lesley Morris
*Assistant Examiner*—Bryan A Evans
(74) *Attorney, Agent, or Firm*—Knobbe Martens Olson & Bear LLP

(57) ABSTRACT

Ski binding (10) for fixing a ski shoe that comprises an upper and a sole (11), having a front retaining element (12) associated with the front end of the sole, a rear retaining element (13) arranged to engage at the foresole or at the heel of the ski shoe, a tensioning means (15, 16, 17, 19) effective between front and rear retaining elements, and having a means, associated with the front retaining element (12) and pivotally mounted relative to the latter about a horizontal axis, for supporting the front end of the sole or sole-supporting means (28), wherein the pivotal axis (29) associated with that supporting means simultaneously defines the pivotal axis about which a structural unit (26) comprising the front and rear retaining elements is pivotable when the shoe heel is lifted or lowered. The sole-supporting means (28) associated with the front end of the sole is pivotable relative to the structural unit (26) and is lockable, as required, by a separate locking element (30).

14 Claims, 4 Drawing Sheets

SKI BINDING, ESPECIALLY TELEMARK BINDING

BACKGROUND OF THE INVENTION

1. Field of the Invention

The invention relates to a ski binding, especially a touring, telemark or cross-country binding, for fixing a ski shoe comprising an upper and a sole, according to the preamble of claim 1.

2. Description of the Related Art

A ski binding of that type is known from WO 03/101555 A1, which originates from the Applicant. That known construction is characterised in that the front retaining element, which can be formed, for example, in the manner of a toe bail, is pivotally mounted, relative to the structural unit comprising the front and rear retaining elements, about an axis that extends transversely to the longitudinal direction of the sole and approximately parallel to the sole tread. The front retaining element is thus of quasi "dynamic" form. The result is that, when the heel of the shoe is lifted, the front retaining element barely offers any resistance. This is achieved as a result of the fact that the front retaining element is able to follow the movement of the front end of the sole relative to the rear retaining element and to the structural unit comprising the two retaining elements. The front end of the sole is thus not compelled to be pushed down by the front retaining element or toe bail onto the upper side of the binding and onto the top face of the ski in such a manner that the front end of the sole always extends parallel to the top face of the ski, and independently of the lifting of the heel of the shoe.

The problem underlying the present invention is to improve the known construction even further in terms of the afore-mentioned "dynamic", and especially also to take steps by means of which the binding can be brought in a simple manner from a "cross-country position" to a "telemark position" and vice-versa, the aim being, in the first-mentioned position, for the shoe heel to be freely liftable in substantially unhindered manner whereas, in the latter position, the aim is for the lifting of the shoe heel to be limited by the elasticity of the shoe sole on the one hand, and by the counter-action of the tensioning means effective between front and rear retaining elements on the other hand. In the "telemark position", the shoe heel is then liftable only slightly, so that the skier can implement the so-called "telemark style".

SUMMARY OF THE INVENTION

That problem is solved by the characterising features of claim 1, with advantageous further developments and constructional details of the invention being described in the sub-claims.

An important aspect of the present invention is therefore that the supporting means associated with the front end of the sole, on which the front end of the sole is supported, is not an integral component of the structural unit comprising the front and rear retaining elements but is pivotable relative to that unit about a horizontal transverse axis and is lockable as required, that is for the so-called "telemark position".

As a result of the fact that the sole-supporting means associated with the front end of the sole is pivotally mounted, the support of the front end of the sole in the "cross-country position" of the binding is dynamic, especially when also the afore-mentioned "toe bail", or front retaining element, is pivotally mounted about a horizontal transverse axis, especially the same horizontal transverse axis. The mentioned "dynamic" is additionally promoted as a result of the fact that the mentioned sole-supporting means is pivotable relative to the structural unit comprising the front and rear retaining elements, or to the connecting member arranged between those two retaining elements, with the result that adaptation to the curvature of the foresole of the shoe is effected when the heel is lifted. The mentioned structural unit and sole-supporting means align themselves to correspond to the curvature of the foresole of the shoe when the heel of the shoe is lifted. When, in that case, the front retaining element, or toe bail, is in addition pivotable about a horizontal transverse axis independently of the afore-mentioned components, the front end of the shoe is maintained substantially free of constraints when the heel of the shoe is lifted.

Preferably, the supporting means associated with the front end of the sole includes a supporting plate or rail associated with the front end of the sole.

The structural unit comprising the front and rear retaining elements or arranged between those two retaining elements can, in a manner known per se, have the form of a strip-like profile or concave profile, especially a tube, U or similar profile. The afore-mentioned structural unit can especially, alternatively, be rigidly formed or be formed so as to be flexurally resilient in the vertical plane. In the case of the latter embodiment, even better adaptation of the support of the foresole to the curvature of the same is achieved when the heel of the shoe is lifted, especially when the foresole of the shoe is of relatively soft construction. The cross-country skier then gets the feeling that he is not only gliding over the snow but is at the same time "walking". The support of the foresole gives the cross-country skier the feeling that he is rolling along the ground underneath.

The locking and catch mechanism associated with the sole-supporting means is described in more detail in claims 4 and 6.

Structurally simple, and nevertheless functionally suitable, is the embodiment according to claim 6, according to which the sole-supporting means and the structural unit comprising the front and rear retaining elements are pivotally mounted about the same pivotal axis, those components, in accordance with the basic concept of the invention, being, of course, pivotable relative to each other about that axis.

The front retaining element is preferably a yoke engaging over the front end of the sole and can be constructed in the manner of a "toe bail". To that extent it is a construction which is known per se, such as is also described and illustrated in WO 03/101555 A1. Preferably, the yoke is also pivotable about the pivotal axis associated with the sole-supporting means and/or afore-mentioned structural unit so that, as pivotal axis for the three elements

- front retaining yoke
- sole-supporting means
- structural unit comprising front and rear retaining elements, there is only a single horizontal transverse axis. Such a construction is functionally suitable and simple, since it requires few components.

In principle, however, it is also conceivable for those three elements each to be provided with a separate pivotal axis, or for only two of those three components to have a common pivotal axis. The simplest embodiment, however, is the first-mentioned, which has only a single common pivotal axis.

For the safety of the skier, especially when setting off in the "telemark position" of the binding, it is especially advantageous when the front and/or rear retaining element allows the shoe to pivot out or disengage from the binding laterally. That measure should also be viewed as an invention, independently of the mentioned main aspect of the present invention. The last-mentioned safety measures are intended therefore to apply also to bindings having solely the features of the preamble of claim 1. An especially preferred embodiment is characterised in that the rear retaining element comprises two yokes, especially two, in plan view approximately L-shaped, retaining yokes, each pivotally mounted about a perpendicular axis and engaging around and over the heel of the sole, which yokes are each pivotable outwards against the action of a resilient element, especially a torsion spring element, when a predetermined torque acts on the shoe.

Alternatively, it is also conceivable for the rear retaining element as a whole to be pivotable about a perpendicular axis so as to enable lateral disengagement of the shoe around the front retaining element as soon as a predetermined lateral torque acts on the shoe.

Also worthy of mention is the embodiment according to claim 11, according to which the operating levers associated, on the one hand, with the tensioning means and, on the other hand, with the locking catch for the sole-supporting means, are each pivotable in opposing directions into tensioning and locking positions, respectively. In that way an especially compact form of construction is achieved. In the afore-mentioned positions of the two operating levers, the levers are positioned quasi one above the other. In order to avoid collision of the two operating levers, one of them is preferably in the form of a U-shaped yoke, so that the other operating lever is able to drop into the space between the two arms of the U-shaped yoke.

Finally, it may, in addition, especially be mentioned that the binding constructed in accordance with the invention is preferably mounted on a sliding carriage, especially a U-profile-like sliding carriage, which is mounted so as to be longitudinally displaceable on the ski, especially on a guiding plate mounted on the ski, and which is fixable on the ski at discrete locations. Simple mounting of the binding, either by the salesman or the user, is therefore possible on the purchase of skis associated therewith.

The same applies for detaching the binding. There is no longer any need for engagement in the ski body by fastening screws or the like to mount the binding. The guiding or mounting plate can be of extremely thin-walled and thus highly flexible construction, with the result that the bending of the ski, or the so-called flex, is not hindered by the mounting plate. Preferably, the guiding and mounting plate consists of an extremely thin-walled plastics profile, the modulus of elasticity of which is lower than or, at most, equal to the modulus of elasticity of the top face of the ski. Preferably, the mounting and guiding plate is adhesively attached to the top face of the ski over a large surface area. The thickness of the mounting and guiding plate is from approximately 0.5 mm to a maximum of 1.5 mm, preferably approximately 1.0 mm.

DETAILED DESCRIPTION OF THE PREFERRED EMBODIMENT

In the following, preferred embodiments of the binding according to the invention are described in greater detail with reference to the accompanying drawings in which.

Figures 1, 2, 3:
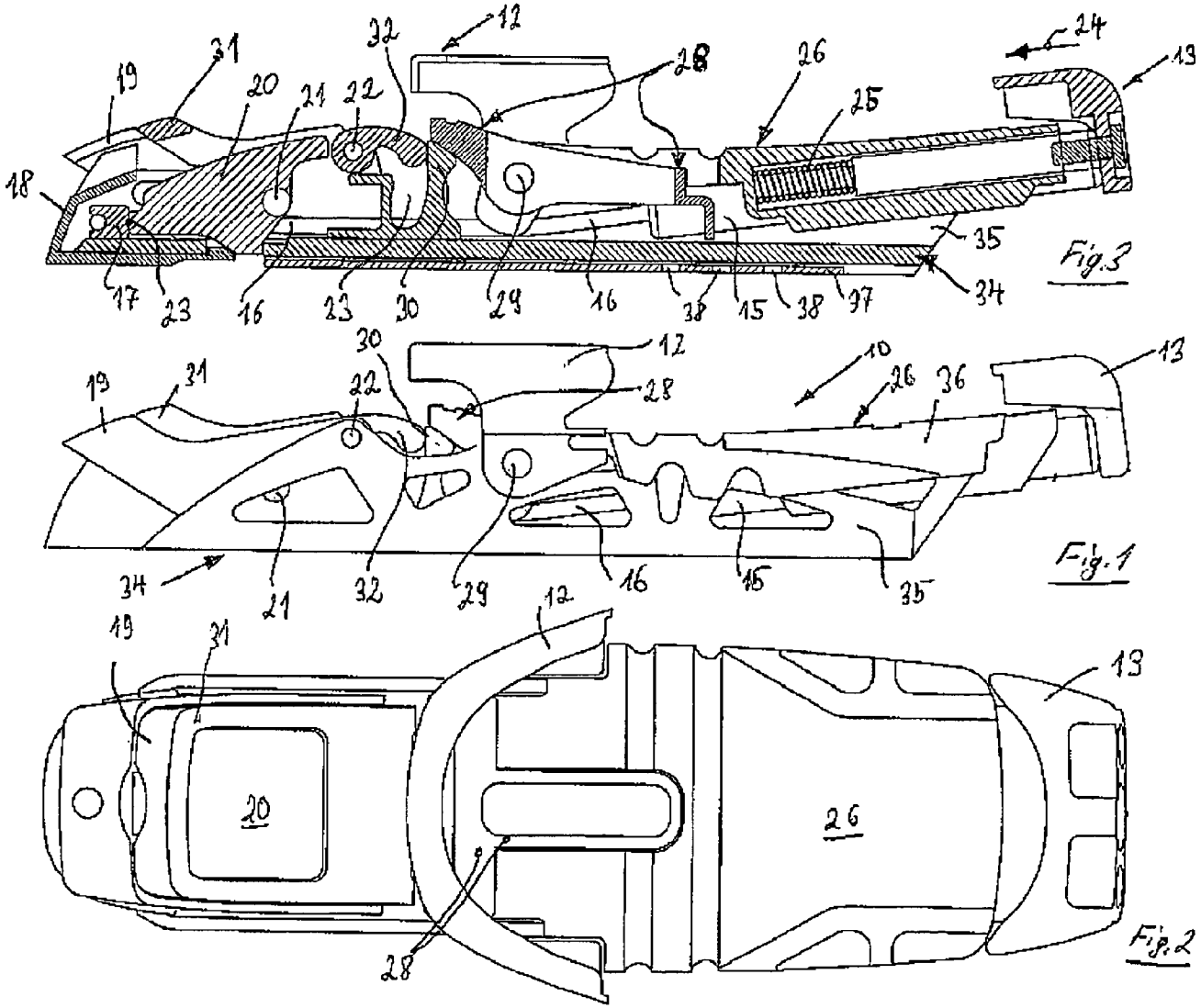
FIG. 1 is a side view of an embodiment of a ski binding constructed in accordance with the invention.
FIG. 2 is a plan view of the ski binding according to FIG. 1.
FIG. 3 shows the ski binding according to FIG. 1 in longitudinal section.
Figure 4:
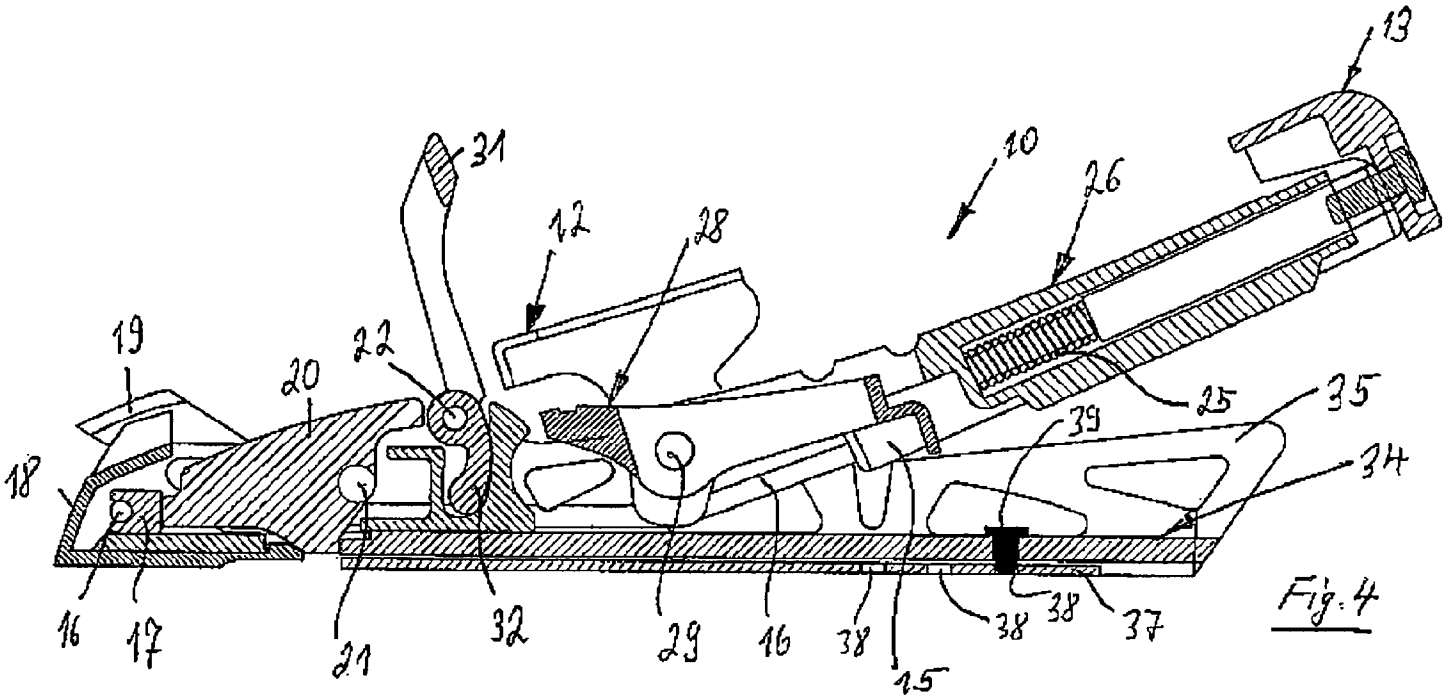
FIG. 4 shows the binding according to FIGS. 1 to 3 in longitudinal section and "cross-country position" in a position in which the heel of the shoe (not shown) is lifted.
Figure 2:
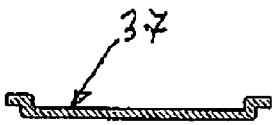
Figure 6:
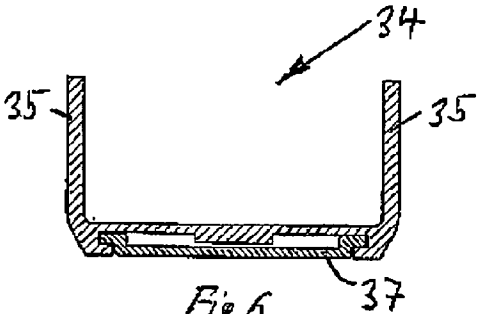
Figures 5A, 5B:
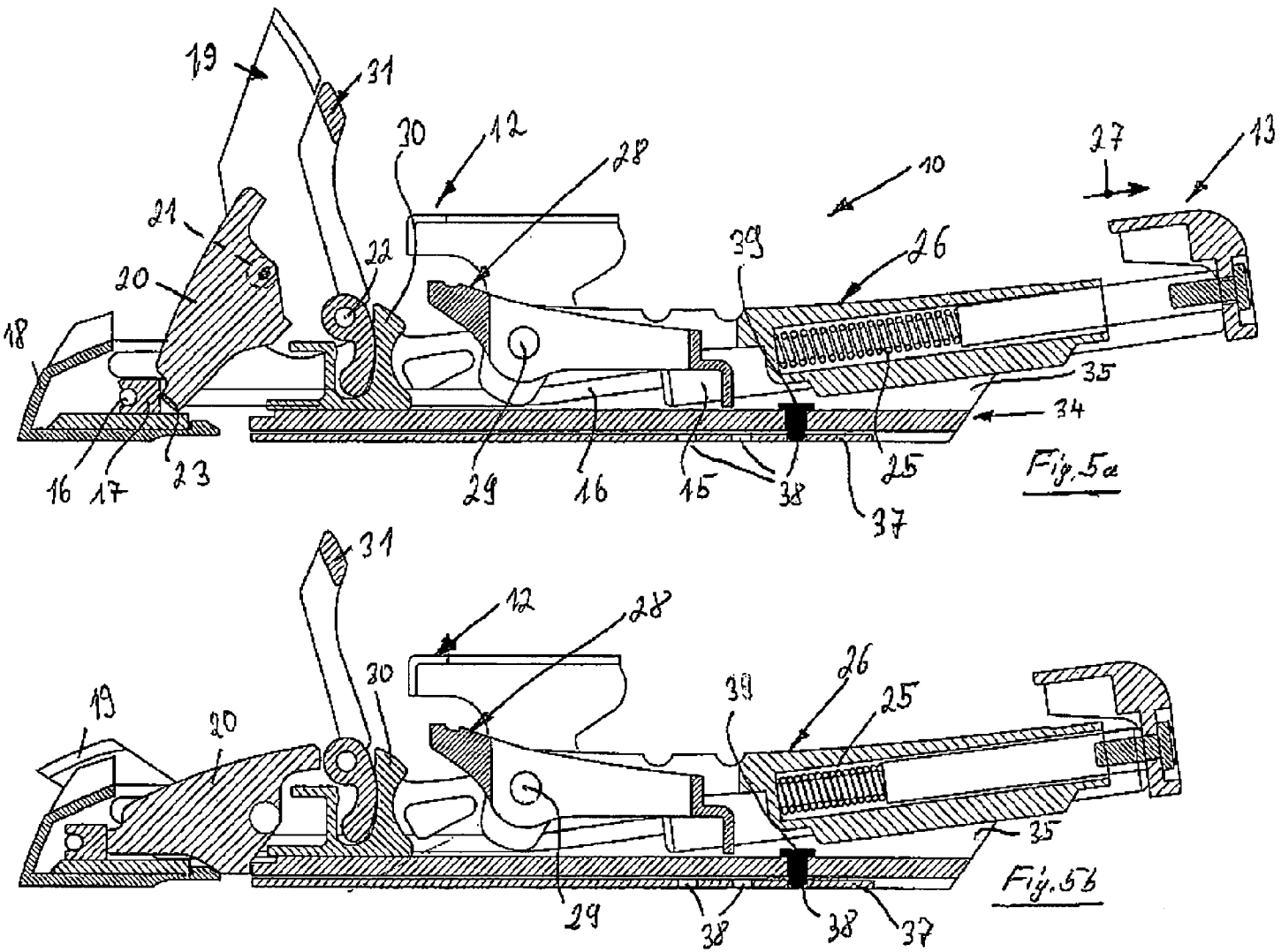
Figure 8:
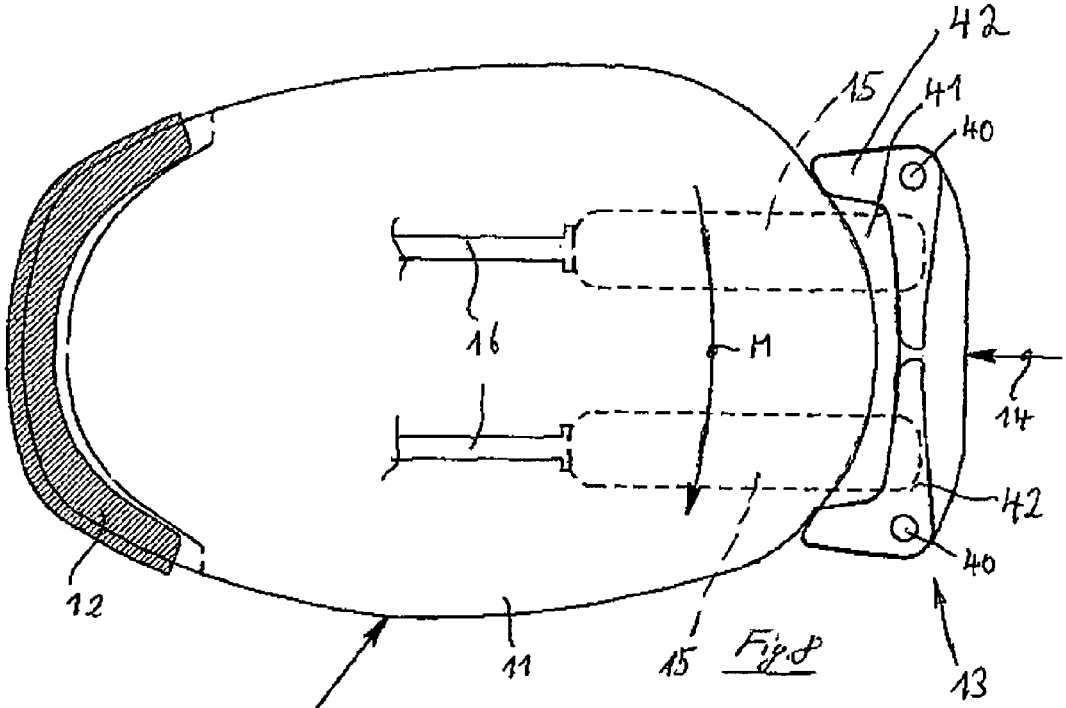
Figure 9:
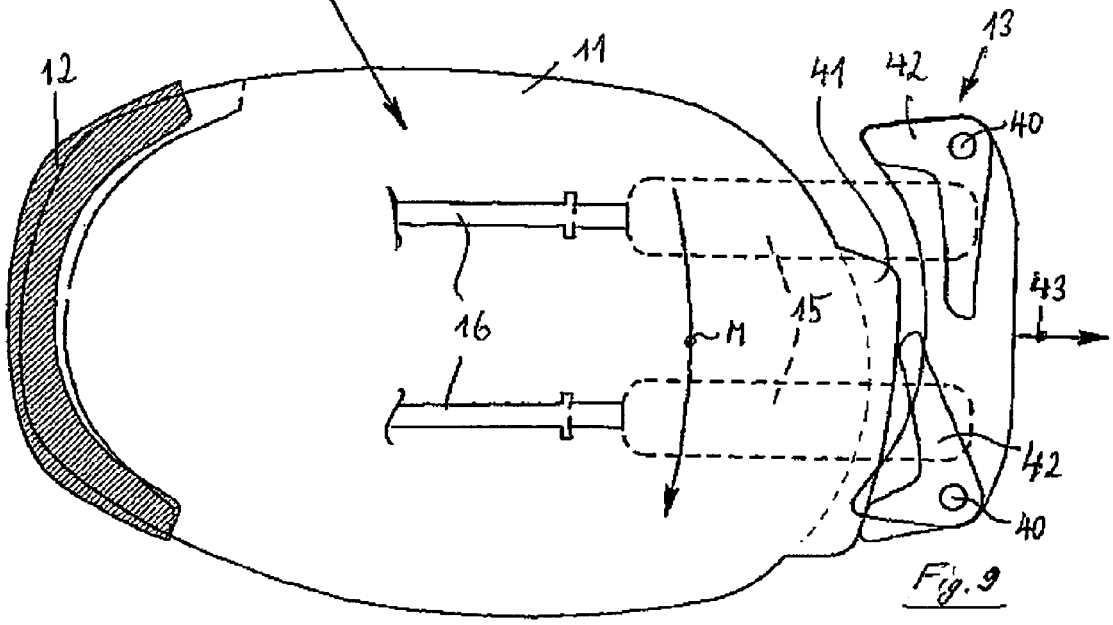

FIG. 5*a* shows the ski binding according to FIGS. 1 to 4 in longitudinal section and in the open state, that is in the entry position;

FIG. 5*b* shows the binding according to FIG. 5*a* in closed position;

FIG. 6 shows, in cross-section, the sliding carriage for mounting the ski binding according to FIGS. 1 to 5 in association with a mounting and guiding plate, which is attachable to the top face of a ski, FIG. 7 shows the mounting and guiding plate according to FIG. 6 in cross-section;

FIG. 8 is a plan view of an embodiment of the ski binding modified in respect of the rear retaining element; and FIG. 9 shows the embodiment according to FIG. 8 illustrating lateral release of the shoe, or of the foresole associated with the shoe, under the effect of a predetermined lateral torque, so that the shoe is released to the side.

The ski binding shown in FIGS. 1 to 7 can be used, on the one hand, as a touring or cross-country binding and, on the other hand, as a telemark binding. It is identified by the reference numeral 10. The ski binding is, of course, for the purpose of fixing a ski shoe comprising an upper and a sole. The ski shoe is not shown in detail. Only in FIGS. 8 and 9 is the outline of a foresole 11 of a ski shoe shown, which is clamped in between a front retaining element 12 and a rear retaining element 13. The corresponding clamping-in action is indicated by the arrow 14. The embodiment according to FIGS. 8 and 9 is, for the remainder, described further below.

Returning to the embodiment according to FIGS. 1 to 7, it should be mentioned that it, also, comprises a front retaining element 12 and a rear retaining element 13 between which, for example, the foresole of a ski shoe can be clamped in against the action of two pressure springs, each arranged inside a spring housing 15, which are operatively connected to the rear retaining element 13, on the one hand, and to a tensioning cable 16, on the other hand, the tensioning cable 16 being guided around a front routing block 17. That routing block 17 is displaceably mounted inside the binding housing 18 in the longitudinal direction of the binding and of the ski, displacement of the routing block 17 being effected by an operating lever 19 which is pivotally mounted about a horizontal transverse axis. In concrete terms, there is in addition arranged between the operating lever 19 and the routing block 17 an actuating cam 20. The actuating cam 20 is pivotally mounted at the operating lever 19 about a horizontal transverse axis 21. In the closed position of the binding according to FIG. 3, that transverse axis 21 lies below the connecting line between the pivotal axis 22 of the operating lever 19 and the engagement point 23 of the actuating cam 20 at the routing block 17. In that "above-dead-centre position", the operating lever 19 is secured in the closed position. In the open position of the operating lever 19 according to FIG. 5*a*, the transverse axis 21 lies clearly above the connecting line between the pivotal axis 22 and the engagement point 23.

By way of the tensioning cable 16, and against the action of the mentioned pressure springs inside the spring housing 15, the rear retaining element 13, which is constructed in the manner of a retaining yoke engaging around and over a rearwardly directed sole protrusion formed in the rear region of the foresole, is movable by means of the operating lever 19 in a forward direction, corresponding to arrow 24 in FIG. 3, that movement also taking place against the action of a further spring element 25 inside a structural unit 26, which is arranged between the front and rear retaining elements, as shown by comparing FIG. 3 or FIG. 5*b*, on the one hand, with FIG. 5*a*, on the other hand.

FIG. 5*a* shows the binding 10 in the open position, that is, with the rear retaining element 13 having a displacement towards the rear in the direction of the arrow 27, caused by the pressure spring 25 inside the structural unit 26, which is arranged between front and rear retaining elements and also comprises those two retaining elements. Movement of the rear retaining element 13 rearwards in the direction of arrow 27 is, of course, rendered possible only by movement of the operating lever 19 into the open position corresponding to FIG. 5*a,* since by that means it is possible for the routing block 17 together with the tensioning cable 16 to move towards the rear, as caused by the spring elements arranged in the spring housings 15.

Otherwise, the spring elements arranged in the spring housings 15 act as a kind of "flexor", that is, they support the return movement of the structural unit 26 towards the ski when the shoe heel is lifted. In addition, the spring elements arranged in the spring housings 15 compensate for bending of the structural unit 26 if that unit is of flexurally resilient construction.

The structural unit 26, which has already been mentioned several times, is of plate-like construction, for the support of the foresole of a ski shoe with the exception of the front sole end of the same. The latter is supported separately by a sole-supporting means 28, which is pivotally mounted relative to the structural unit 26. The associated pivotal axis extends horizontally and transversely relative to the longitudinal direction of the binding and of the ski. It is identified by the reference numeral 29. The structural unit 26, also, is pivotally mounted about that pivotal axis 29, and preferably relative to the supporting means 28 associated with the front end of the sole. In addition, there is preferably also pivotally mounted about that pivotal axis the front retaining element 12, which is constructed in a manner known per se as a yoke engaging over the front end of the sole or in the manner of a "toe bail".

As can be seen from a comparison between FIG. 3, on the one hand, and FIGS. 5*a* and 5*b*, on the other hand, the sole-supporting means 28 associated with the front end of the sole, which means, in the embodiment shown, is of bar-like construction, is lockable, as required, by a separate locking element in such a manner that pivoting about the pivotal axis 29 is blocked (see FIG. 3). For that purpose, there is associated with the front end of the sole-supporting means 28 a locking catch 30 which, by means of an operating lever 31, is displaceable into a position beneath the front end of the sole-supporting means 28 to such an extent that it comes to rest against the underside of the front end of the supporting means 28. When, corresponding to FIGS. 5*a* and 5*b*, the operating lever 31 is raised, the sole-supporting means 28 associated with the front end of the sole is unlocked, with the result that it is able to pivot about the axis 29. The structural unit 26 is consequently also released to pivot about the axis 29. In that unlocked position of the locking catch 30, the binding is located in the so-called "cross-country position", whereas FIG. 3 shows the binding in the so-called "telemark position".

The operating lever 31 comprises a cam 32, which engages in a complementary recess 33 in the locking catch 30 with the result that, by pivoting the operating lever 31 about a horizontal transverse axis, in the present case the pivot axis 22, there is a corresponding displacement of the locking catch 30 out of its release position, corresponding to FIGS. 5*a*, 5*b,* into the locking position, corresponding to FIG. 3, and vice versa. It can be seen from the above description and the illustration in FIGS. 3, 5*a* and 5*b* that the two operating levers 19 and 31 have a common pivotal axis, that is, the pivotal axis 22.

It can also be seen from the afore-mentioned Figures that the components structural unit 26 sole-supporting means 28 front retaining element 12 have a common pivotal axis, that is, the pivotal axis 29. That pivotal axis construction is especially simple, since it is distinguished by a minimum number of components.

It should, at this point, be mentioned again that the sole-supporting means is associated only with the front end of the sole. Accordingly, the front end of the sole is fitted in between the front retaining element 12, on the one hand, and the mentioned sole-supporting means 28, on the other hand, that is, it is held between those two elements and is supported above and below. The lateral support for the front end of the sole is effected likewise by the front retaining element 12, which is formed in the manner of a toe bail (see also FIG. 2).

It is also possible for the front retaining element 12 and the sole-supporting means 28 each to be pivotally mounted jointly, that is, not independently of each other, about the pivotal axis 29. Alternatively, however, those two components can additionally be pivotable relative to each other. In any event, relative pivotability between structural unit 26, on the one hand, and front retaining element 12 and also sole-supporting means 28, on the other hand, is important.

At this point, attention should also be drawn, in addition, to FIG. 4, which shows, in longitudinal section, the binding 10 in the closed position and with the shoe heel lifted. The sole-supporting means 28 associated with the front end of the sole is unlocked and is thus, like the front retaining element 12 and the structural unit 26 comprising the front retaining element 12 and the rear retaining element 13, pivotable about the pivotal axis 29.

FIG. 4, like FIG. 1, shows clearly that the described binding 10 is mounted on a sliding carriage 34 having two side cheeks 35. Those two side cheeks 35 lie inside corresponding side cheeks 36 of the structural unit 26 which extend downwards (see FIG. 1). By that means, optimum lateral stability of the structural unit 26 relative to the sliding carriage 34 and thus to the connection to the ski is achieved.

In FIG. 6, the sliding carriage 34 is shown again, separately, in cross-section. The sliding carriage 34 is thus constructed as a kind of U profile. The sliding carriage 34 is also mounted so as to be displaceable longitudinally on a mounting and guiding plate 37, not shown here, and is fixable at discrete locations 38. Those discrete locations 38 are defined by longitudinally spaced holes arranged in the mounting and guiding plate 37, into which holes a fixing pin 39 engages (see FIG. 5*a* and FIG. 5*b*).

The two operating levers 19, 31, can each be pivotable in the same direction—as in the embodiment shown—or in opposing directions into tensioning and locking positions, respectively. They are furthermore so arranged that they do not collide with each other. For that purpose, both operating levers are in the form of a U-shaped yoke, it being possible for the actuating cam 20 to drop into the free area between the two arms when the operating levers 19, 31 are moved into the closed and locking positions, respectively, as can be seen from FIGS. 2, 3 and 4.

In the following, attention is drawn again to the embodiment according to FIGS. 8 and 9. That embodiment differs from the above-described embodiment solely in the respect that the rear retaining element 13 comprises two yokes, that is two, in plan view approximately L-shaped, retaining yokes 42, each pivotally mounted about a perpendicular axis 40 and engaging around and over a rearwardly projecting sole protrusion 41, which yokes are each pivotable outwards against the action of a resilient element, especially a torsion spring element, when a predetermined lateral torque "M" acts on the shoe (see lower retaining yoke 42 in FIG. 9).

At the same time, the rear retaining element 13 is in that case displaced towards the rear, in the direction of the arrow 43 in FIG. 9, against the action of the afore-mentioned spring elements. The foresole 11, together with the associated shoe, can thus move aside laterally, and rotates quasi about the front retaining element 12 (see FIG. 9). A high level of safety for the user of the described binding, especially also in respect of compound torsion fractures, is achieved in that manner.

All of the features disclosed in the application documents are claimed as important to the invention insofar as they are novel, individually or in combination, compared with the prior art.

What is claimed is:

1. Ski binding for touring, telemark or cross-county skiing, for fixation of a ski boot that comprises a sole and a heel, wherein the ski binding comprises:

a front retaining element configured to engage the front of the ski boot;

a rear retaining element configured to engage the rear of the sole or the heel of the ski boot;

a clamping mechanism configured to clamp the ski boot by the front retaining element and the rear retaining element, wherein one of the retaining elements can be actuated to clamp or release the ski boot from the ski binding;

a pivotable member configured to pivot relative to the front retaining element, wherein pivoting of the pivotable member allows the heel of the ski boot to lift; and a sole-support member configured to pivot relative to the pivotable member, wherein the sole-support member and the pivotable member are pivotable about the same axis of rotation, wherein the sole-support member is lockable by a locking element of the ski binding to lock the sole-support member and the pivotable member from pivoting.

2. Ski binding according to claim 1, wherein the sole-support member comprises a support plate, support strip or support web.

3. Ski binding according to claim 1, wherein the pivotable member comprises a profile having a strip-like or hollow form, and either is rigid or is flexible in the vertical plane.

4. Ski binding according to claim 1, wherein the locking element comprises a locking latch that can be pivoted and/or linearly shifted by means of an actuating lever, to move the locking latch out of a position in which the sole-support member is released and into a locking position, or in the reverse direction.

5. Ski binding according to claim 4, wherein the actuating lever comprises a cam that engages a complementary recess in the locking latch, so that pivoting of the actuating lever causes the locking latch to change position accordingly, from a release position to the locking position or conversely.

6. Ski binding according to claim 1, wherein the front retaining element comprises a toe iron, with a metal piece that extends over the sole that can likewise be pivoted about the axis of rotation associated with the sole-support member and the pivotable member.

7. Ski binding according to claim 1, wherein the rear retaining element comprises two metal parts that are seated so as to extend around and over a sole projection and to be pivotable about an upright axis, in particular retaining irons that are approximately L-shaped in plan view, each of which can be pivoted outward against action of an elastic element, while a predetermined lateral moment of torque "M" acts on the ski boot to release the ski boot.

8. Ski binding according to claim 1, wherein the clamping mechanism further comprises a lever configured to actuate one of the retaining elements.

9. Ski binding according to claim 8, wherein the locking element is disposed between the front retaining element and the lever.

10. Ski binding according to claim 9, wherein the levers and the locking element are pivotable, in the same direction or opposite directions, into a tensioning and/or locking position, to move into an upper dead centre position, and conversely.

11. Ski binding according to claim 1, wherein the ski binding is mounted on a slide seated on the ski so that the slide can be shifted in the long direction and fixed at discrete positions.

12. Ski binding of claim 3, wherein the profile is tubular of J-shaped.

13. Ski binding of claim 7, wherein the elastic element is a spring.

14. Ski binding of claim 11, wherein the slide is a U profile slide.

* * * * *

UNITED STATES PATENT AND TRADEMARK OFFICE

CERTIFICATE OF CORRECTION

PATENT NO. : 7,681,905 B2
APPLICATION NO. : 11/701642
DATED : March 23, 2010
INVENTOR(S) : Bernt-Otto Hauglin It is certified that error appears in the above-identified patent and that said Letters Patent is hereby corrected as shown below:

In column 7, line 17, in Claim 1, please change “cross-county” to --cross-country--.

In column 8, line 22, in Claim 7, please change “element,” to --element--.

In column 8, line 31, in Claim 10, please change “levers” to --lever--.

Signed and Sealed this
Fifth Day of June, 2012

David J. Kappos

David J. Kappos
*Director of the United States Patent and Trademark Office*